United States Patent [19]

Zaoralek

[11] Patent Number: 4,875,297

[45] Date of Patent: Oct. 24, 1989

[54] DEVICE FOR TREATING A MATERIAL WEB

[75] Inventor: Heinz-Michael Zaoralek, Königsbronn, Fed. Rep. of Germany

[73] Assignee: Schwabische Huttenwerke GmbH, Postfach, Fed. Rep. of Germany

[21] Appl. No.: 206,679

[22] Filed: Jun. 15, 1988

[30] Foreign Application Priority Data

Jun. 16, 1987 [DE] Fed. Rep. of Germany ..... 3720132

[51] Int. Cl.[4] ..... F26B 19/00

[52] U.S. Cl. ..... 34/48; 34/41; 34/124

[58] Field of Search ..... 34/41, 43, 46, 48, 49, 34/113, 119, 124

[56] References Cited

U.S. PATENT DOCUMENTS 2,268,988 1/1942 Hess et al. ..... 34/48 X
3,016,622 1/1962 Gade et al. ..... 34/48
3,748,224 7/1973 Tillie et al. ..... 34/48 X
4,624,744 11/1986 Vreeland ..... 162/206

FOREIGN PATENT DOCUMENTS 3014891 10/1981 Fed. Rep. of Germany .
3304076 8/1984 Fed. Rep. of Germany .
3518808 11/1986 Fed. Rep. of Germany .

*Primary Examiner*—Harry B. Tanner
*Attorney, Agent, or Firm*—Ratner & Prestia

[57] ABSTRACT

A device for treating a material web comprising a heating roller with at least one flow channel extending through the heating roller in its longitudinal direction, feed and return pipes for a heat carrier fluid flowing through the heating roller, a heating device for the heat carrier, and a counter roller, which is in contact with the heating roller; an additional heating device heats the heating roller from the outside; and a control unit connected to both heating devices heats or cools the heating roller as a function of predetermined operating conditions.

18 Claims, 2 Drawing Sheets

Figure 1:
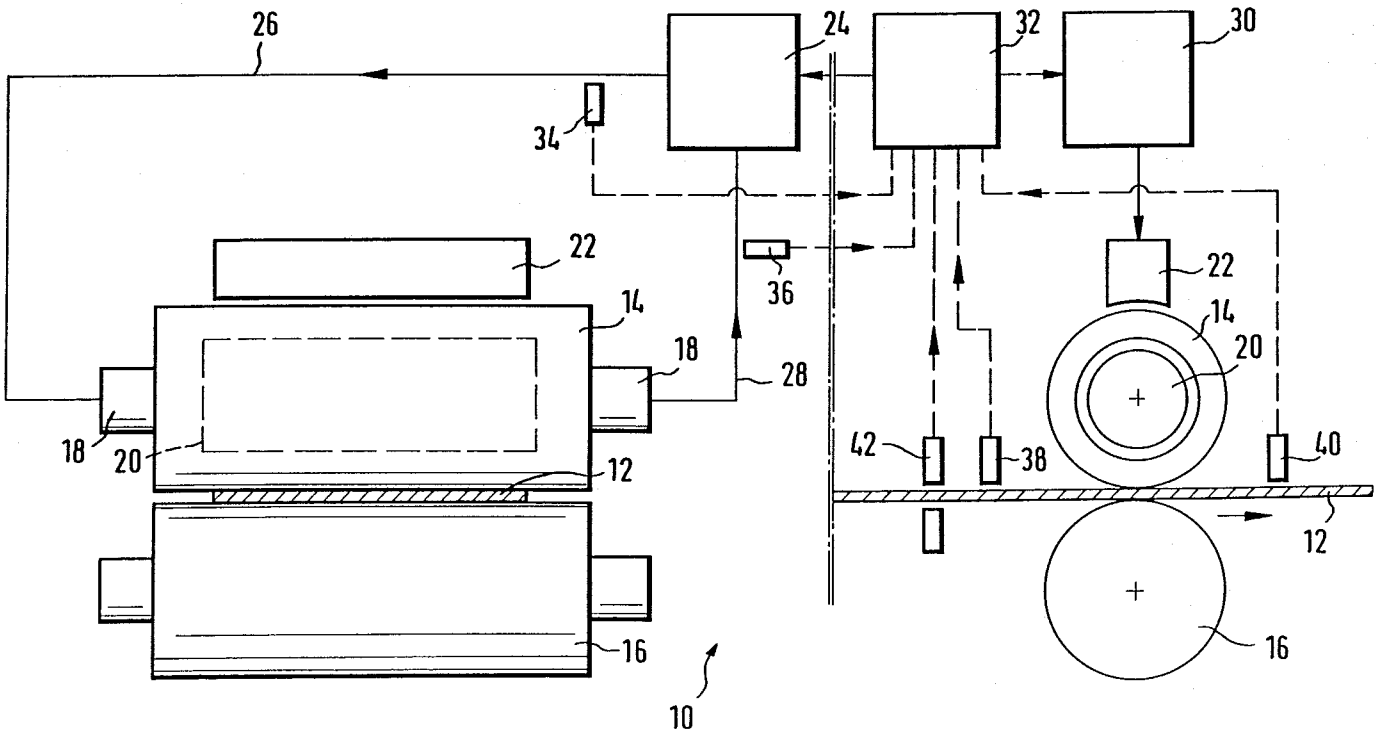

$T_i$
=
$T_a$
<<
>>
$f(T_a)$
$\sigma_i$
$\sigma_a$

DEVICE FOR TREATING A MATERIAL WEB

The invention relates to a device for treating a material web comprising a heating roller, at least one flow channel extending through the heating roller in its longitudinal direction, feed and return pipes for a heat carrier fluid flowing through the flow channel, a heating device for the heat carrier, and a counter roller in contact with the heating roller.

Such a device is used especially for manufacturing and processing paper. Attempts have been made in the past few years to operate such a device at extremely high temperatures in order to achieve certain effects (cf. U.S. Pat. No. 4,624,744, as well as the article entitled "On-line Glattverfahren" ("On-Line Smoothing Process"), published in *Wochenblatt für Papierfabrikation* (1986), No. 23/24, p. 984, or the article entitled "*Kann der Gloss-Kalander den MG-Zylinder ersetzen?*" ("Can a Glossing Calender Replace the MG Cylinder?") published in *Wochenblatt für Papierfabrikation* (1985), No. 22, p. 871.)

Two basic principles are available for constructing the heating roller: internal heating by a heat carrier fluid, especially thermal oil, or external, especially inductive heating, as was disclosed e.g. in European Patent Specification No. 59,421. Blowing with warm air or infrared heating are also possible as alternatives.

The advantage of external heating is the fact that very high thermal outputs and consequently very high surface temperatures can be reached for continuous operation.

Two basic types are distinguished among the internally heated rollers: (a) rollers with displacement bodies, as are known from West German Offenlegungsschriften Nos. 3,014,891 and No. 35,18,808 (corresponding to Canadian Patent No. 508,684) and (b) peripherally drilled rollers.

Rollers with displacement bodies, the so-called "tubular rollers", can be manufactured with highly accurate dimensions, so that unbalances can be practically completely eliminated. In addition, such rollers can also be balanced in three planes, as is known from West German Offenlegungsschrift No. 3,304,076. A uniform temperature profile, which is desirable for many applications, can be achieved in the circumferential direction of the roller.

However, the relatively great wall thickness of the actual roller body, which reduces the thermal output, is a disadvantage of such tubular rollers. In addition, undesirable effects, e.g. the oxbow effect, which must be compensated for by appropriate design solutions—see Offenlegungsschrift No. 35,18,808—may occur in the case of great temperature differences.

The advantage of the peripherally drilled rollers over rollers with central bores is the fact that the heating surface is closer to the roller surface, i.e. it is possible to reach higher thermal outputs. The disadvantages of such rollers include inaccuracies in the preparation of the peripheral bores and the associated unbalances, as well as undulating temperature profiles in the circumferential direction; no compensating measures are available here.

The desired high surface temperatures in the range exceeding 200° C. cannot be reached alone with the above-discussed conventional designs of heating means for such rollers in a reliable manner; it was also found that if sch rollers are operated at high temperatures, the strength of the roller body is insufficient and mechanical defects and consequently malfunctions occur relatively frequently.

Therefore, the basic object of the present invention is to provide a device for treating a material web of the type specified, in which the above-mentioned disadvantages do not occur.

In particular, a device is to be proposed which shows no mechanical defects even in the case of prolonged operation at extremely high temperatures.

This is achieved in a device for treating a material web of the specified type in that an additional heating device heats the heating roller from the outside, and that a control unit connected to both heating devices raises or lowers the temperature of the heating roller as a function of predetermined operating conditions.

The advantages achieved with the present invention are based on the following considerations:

Great radial temperature differences between the surface of the roller body and its inside, e.g. its central axis, can develop during the operation of such rollers at high temperatures. These temperature differences can lead to tensile or compressive stresses in the roller body, which in turn cause stresses on the material of the roller body and, especially in the case of major fluctuations, cause cracks or even ruptures in the roller body.

Such great temperature differences arise especially in the unsteady state, i.e. during the starting-up and the cooling down of such a roller, failure of the heating, absence of the web-like material to be treated, or interruption in the heat-/carrier flow.

It is pointed out in this connection that a roller body is heated at a rate of e.g. 1° C. per minute, i.e. ca. 4 hours are needed to raise the temperature of the roller body to 200° C. Higher heating rates lead to an excessively rapid build-up of pressure in the surface of the roller, which increases the internal compressive stress of the roller body, thus causing internal tensile stresses which can ultimately cause cracking or even rupture of the roller body.

The steady-state operation, but especially the non-steady-state operation during the starting-up and cooling down, but also in the case of malfunctions, can be controlled by the use of "double heating" such that the temperature difference between the central axis of the roller body and its surface always remains at the lowest possible value, so that no stresses, which could cause cracks or ruptures, can occur.

It must be borne in mind in particular that under normal operating conditions there is a very delicate equilibrium between the amount of heat supplied and the amount of heat removed by radiation, but also by the heating of the material to be treated, i.e. even a slight disturbance in this equilibrium may lead to a major temperature change.

It is therefore important to respond immediately to any deviations from the normal operating conditions and to take an appropriate countermeasure, e.g. to cool the heat carrier, thus ensuring that cooling of the surface of the roller body, e.g. because of the lack of the web-shaped material to be treated, will be compensated for so much that the temperature difference will be $\Delta T=0$ in the ideal case.

The presence of the web to be treated is also an important parameter which influences the temperature changes, so that a preferred embodiment provides a photoelectric or light barrier which repsonds to the absence of the web and initiates the corresponding countermeasures via a control unit.

In addition, temperature sensors should be provided on the feed line and the return line of the fluid heat carrier, since both the thermal output and the internal temperature of the roller body can be calculated from the temperatures thus determined.

The continuous sensing of the surface temperature of the roller body is problematic, since contactless operation should be ensured here whenever possible. If none of the direct measuring methods available is desirable, it is possible to continuously determine the temperature of the material web to be treated and to calculate the supplied thermal output as well as the temperature on the surface of the roller body from the values thus measured, i.e. to perform an indirect measurement.

The temperature profile of the roller body in both radial and longitudinal directions, as well as the stresses in the roller body, can be determined by a simulation program, and they can be taken into account in connection with the control of the thermal outputs of the two heating devices.

According to a preferred embodiment, a tubular roller, i.e. a roller body with displacement bodies, is used, because an adequately controllable temperature profile as well as a uniform temperature profile in the circumferential direction of the roller can thus be achieved.

Roller bodies with a central bore for the through flow of the heat carrier are problematic insofar as the heat transfer from the central bore to the surface of the roller body is relatively poor, and great temperature differences can thus develop in a short time.

Consequently, unless a tubular roller is used, a peripherally drilled roller should be used, in which the bores are located relatively close to the surface of the roller body in order to thus reach high thermal outputs, on the one hand, and good heat transfer, on the other hand.

The temperature is always controlled by supplying under normal operating conditions as much energy by the external heating device, e.g. an inductive heating device, as is removed by the material web to be treated, on the one hand, and by the heat carrier, on the other hand, so that the temperature difference will be extremely small in the radial direciton of the roller body, reaching the value of $\Delta T=0$ in the ideal case. Thermal stresses in the roller body are thus avoided at practically any heat output and consequently even at extremely high temperatures. During intermittent operation, i.e. especially in the case of the above-mentioned disturbances, the temperature in the roller body can be adjusted to the outside temperature on the surface of the roller body; the temperature difference between the surface of the roller body and its core can thus be reduced by heating or cooling the heat carrier, which also leads to small temperature differences, so that any risk of cracking or rupture of the roller body is ruled out.

Another advantage of this highly accurate temperature setting of the roller body is the fact that it is now possible to use roller bodies made from special chill-cast alloys of increased thermal conductivity, which are needed especially for paper machine calenders. Such an alloy has a fine structure containing hard carbide inclusions in a pearlitic matrix, which results in good damping in conjunction with good shape stability. In addition, the surface of such a roller body is not polished smooth, which could lead to a too great smoothness. Markings on the surface of the roller body are ruled out.

However, this material has a serious disadvantage, which can cause problems in the case of great temperature differences: it has a relatively low strength. However, major radial temperature differences are eliminated essentially completely by the temperature control described here, so that the required strength of the roller body remains low, and the breaking point of the chill-cast material used is not reached either.

The present invention will be explained below in greater detail on the basis of examples of embodiment, with reference to the schematic drawings appended.

FIG. 1 shows a schematic representation with two different views of a device for treating a material web.

FIGS. 2*a*–2*d* show the compressive and tensile stress curves of a heating roller as a function of the temperature difference between the surface of the roller body and its core for different operating conditions.

The device for treating a material web 12, which is shown in FIG. 1 and is generally identified by the reference numeral 10, has a heating roller 14, with which a counter roller 16 is in contact. The counter roller 16 may also be heated.

The heating roller 14, which is mounted rotatably around its longitudinal axis by means of the flange journals 18 in the usual manner, is provided with an internal heating 20 indicated schematically, i.e. either with peripheral bores in the vicinity of the surface of the body of the heating roller 14, or with a displacement body; a heat carrier fluid, in general, thermal oil, flows either through the peripheral bores or through the annular gap between the displacement body and the roller jacket.

External heating 22, e.g. an inductive heating, which couples electromagnetic energy into the material of the body of the heating roller 14 thus bringing about a temperature rise especially of the roller surface, is provided in the vicinity of the surface of the heating roller 14.

A device 24 feeds the heat carrier fluid into the heating roller 14 via a pipe 26 in the direction of the arrow, usually through the left flange journal 18 as seen in FIG. 1. After flowing through the heating roller 14, the heat carrier leaves the heating roller 14 through the right flange journal 18 and then returns into the device 24 through the pipe 28 in the direction of the arrow, so that a closed heat carrier cycle is provided. The device 24 may heat or cool the heat carrier, i.e. it can serve as a heating/cooling device.

The energy supply unit for external heating 22 is indicated by reference numeral 30.

A control unit 32 controls both the heating/cooling device 24 and the energy supply unit 30 and receives signals from different sensors; i.e. a first sensor 34 which measures the temperature of the heated heat carrier in the pipe 26, a second sensor 36 which measures the temperature of the returning heat carrier in the pipe 28, a third sensor 38 which measures the temperature of the material web 12 to be treated before running through the gap between the two rollers 14 and 16, a fourth sensor 40 which measures the temperature of the material web 12 after it has left the gap between the two rollers 14 and 16, finally, a photoelectric or light barrier 42, which is arranged in the direction of movement of the material web 12 (see arrow in FIG. 1) upstream of the two rollers 14 and 16 and detects the presence of the material web 12.

The signals produced by the different sensors 34, 36, 38 and 40, i.e. the actual values of the various temperatures, are compared with predetermined nominal values in the control unit 32, so that the two heating devices 24 and 30 are controlled as a function of the result of this comparison; the said heating devices cause the temperature difference between the surface of the heating roller 14 and its core to be as small as possible, especially by heating or cooling the heat carrier.

In addition, countermeasures are immeditely taken in the absence of the material web 12, which is detected by the photoelectric or light barrier 42, in order to compensate the accompanying temperature drop on the surface of the heating roller 14.

The body of the heating roller 14 consists of a chill-cast alloy of high thermal conductivity, so that the above-described advantages are achieved.

Both the output of the internal heating and the internal temperature of the heating roller 14 can be calculated from the output signals of the two sensors 34 and 36, which are located in the heat carrier feed pipe and the return pipe respectively, and these parameters can thus be taken into account for the control.

The thermal output and the temperature on the surface of the body of the heating roller 14 can also be determined from the temperature difference of the material web before and after passing through the gap between the two rollers 14 and 16, which difference is measured by the sensors 38 and 40. The temperature profile of the heating roller and consequently its stresses can be determined on the basis of a simulation program.

FIGS. *2a–2d* show the stresses in the wall of a tubular roller under various operating conditions;

the dashed line represents the condition where neither compressive nor tensile stress exists in the roller, below that line compressive stress exists in the roller, above the dashed line tensile stress exists in the roller, the dashed and dotted line represents the tensile strength of the roller.

FIG. *2a* shows the distribution of the internal stresses from the inside to the outside at room temperature, i.e. for the case in which the temperature $T_i$ inside the roller is equal to the temperature $T_a$ on the surface of the roller. A tensile stress $O_i$, which is greater than 0 but smaller than the tensile stress of the chill-cast alloys commonly used, occurs inside the roller even in this most favorable case; whereas a compressive stress of $O_a$ occurs on the surface of the roller.

Figures 2A, 2B, 2C, 2D:
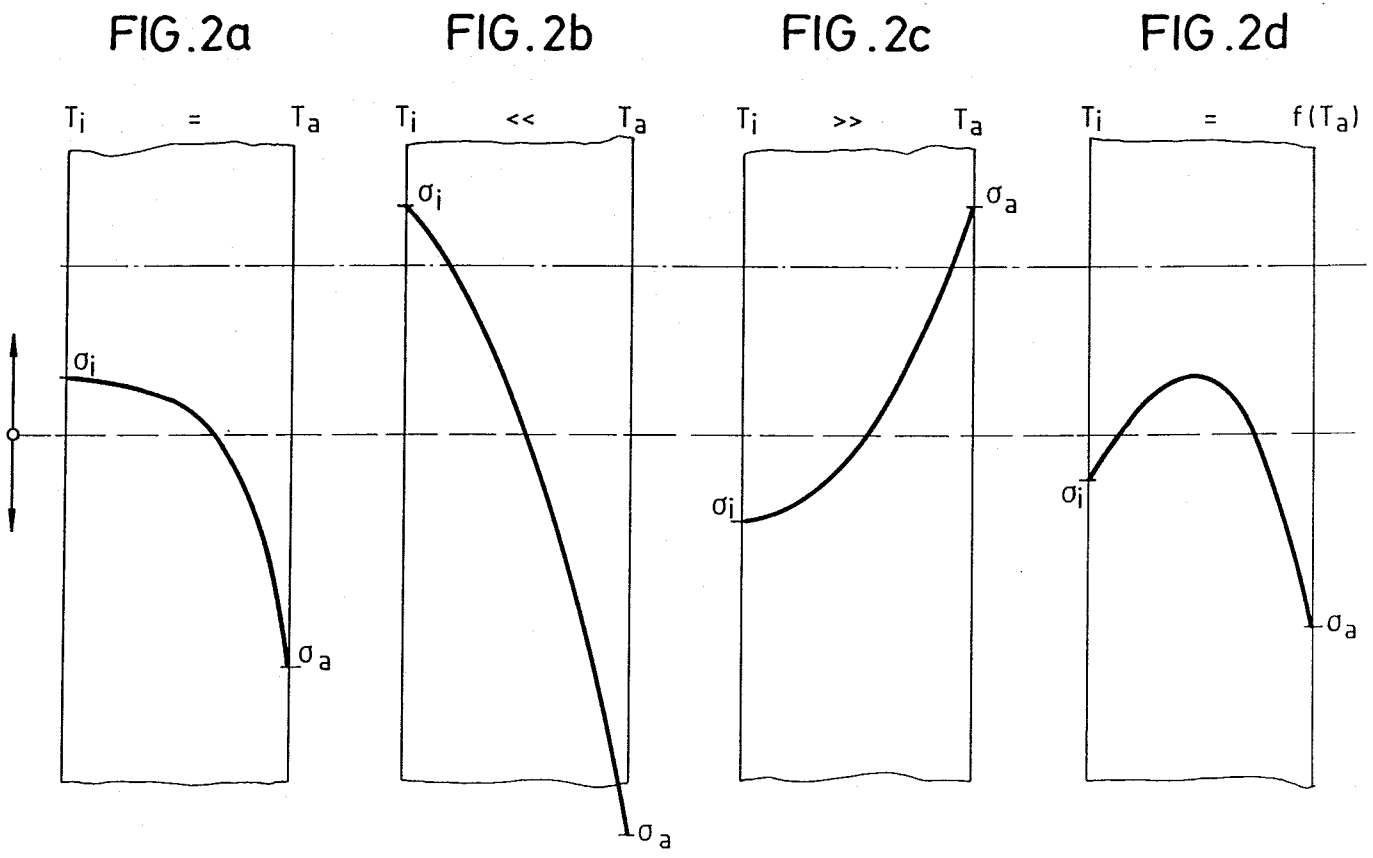

If the roller is heated too rapidly from the outside, the temperature $T_a$ on the surface of the roller rises very rapidly to a value that is much greater than the temperature $T_i$ inside the roller; i.e. both the tensile stress $O_i$ and the compressive stress $O_a$ will greatly increase, so that the permissible limit value of the tensile strength of the material will soon be exceeded, and, as can be inferred from FIG. 2b, the roller will crack inside.

FIG. *2c* shows a roller with internal heating or a roller shortly after the failure of the external heating; here the temperature $T_a$ on the surface of the roller drops very rapidly to a value that is much lower than the temperature $T_i$ inside the roller; i.e. a tensile stress $O_a$ which is above the limit value for the tensile strength develops on the surface of the roller, while a compressive stress $O_i$ builds up inside the roller. Consequently, the roller will crack on the outside under these conditions.

Finally, FIG. *2d* shows the stress distribution in a roller with controlled internal and external heating, as was described above; it can be seen that even compared with the steady state at room temperature, which is shown in FIG. 2a, the difference betewen the compressive stress $O_i$ inside the roller and the compressive stress $O_a$ on the surface of the roller is much smaller and leaves a sufficient safety margin relative to the tensile strength of the material. Consequently, there is no risk of cracking or especially rupture of the roller.

What is claimed is:

1. A device for treating a material web, comprising:

a heating roller, said heating roller including means for introducing heat carrier fluid into the interior of said heating roller at a controlled temperature;

a counter roller, proximate said heating roller, defining a material web path therebetween;

a heat source, proximate said heating roller adapted to heat the surface of said heating roller; and a control means adapted to control the temperature difference between the interior and the surface of said heating roller.

2. A device as recited in claim 1, further including;

means for moving said material web through said material web path;

a first web sensor for sensing the temperature of said material web before introduction into said web path, and for providing to said control means a first signal indicative thereof; and a second web sensor for sensing the temperature of said material web after said web has passed through said web path, and for providing to said control means a second signal indicative thereof;

said control means also including means to receive said first and second signals and, in response thereto, to control heat input to said web from said heating roller.

3. A device as recited in claim 1, further including;

first means for determining the temperature of said heat carrier fluid fed into said first roller, and for providing to said control means a signal indicative thereof;

second means for determining the temperature of said heat carrier fluid leaving said first roller, and for providing to said control means a signal indicative thereof;

said control means also including means to receive said signals and, in response thereto, to control heat input to said roller from said heat carrier fluid.

4. A device as recited in claim 2, further including;

first means for determining the temperature of said heat carrier fluid fed into said first roller, and for providing to said control means a third signal indicative thereof;

second means for determining the temperature of said heat carrier fluid leaving said first roller, and for providing to said control means a fourth signal indicative thereof;

said control means also including means to receive said third and fourth signals and, in response thereto, to control heat input to said roller from said heat carrier fluid.

5. A device as recited in claim 1, wherein said heat source is an inductive heating device.

6. A device as recited in claim 1, wherein said heating roller is a tubular roller.

7. A device as recited in claim 3, wherein said heating roller is a tubular roller.

8. A device as recited in claim 1, wherein said heating roller has peripheral bores in the vicinity of its surface.

9. A device as recited in claim 3, wherein said heating roller has peripheral bores in the vicinity of its surface.

10. A device as recited in claim 1, wherein said control means is a closed loop control unit.

11. A device as recited in claim 2, wherein said control means is a closed loop control unit.

12. A device as recited in claim 3, wherein said control means is a closed loop control unit.

13. A device as recited in claim 4, wherein said control means is a closed loop control unit.

14. A device as recited in claim 4, further including a third web sensor for sensing the presence or absence of said web.

15. A device as recited in claim 14, wherein said sensor is photoelectric.

16. A device for treating a material web, comprising:

a heating roller, said heating roller including means for introducing heat carrier fluid into the interior of said heating roller at a controlled temperature;

a counter roller, proximate said heating roller, defining a material web path therebetween;

an inductive heating device, proximate said heating roller adapted to heat the surface of said heating roller;

a closed loop control unit adapted to receive control signals and, in response thereto, to control the temperature difference between the interior and surface of said heating roller, heat input to said roller from said heat carrier fluid, and heat input to said web from said heating roller;

means for moving said material web through said material web path;

a first web sensor for sensing the temperature of said material web before introduction into said web path, and for providing to said control unit a control signal indicative thereof;

a second web sensor for sensing the temperature of said material web after said web has passed through said web path, and for providing to said control unit a control signal indicative thereof;

a third web sensor for sensing the presence or absence of said web;

first means for determining the temperature of said heat carrier fluid fed into said first roller, and for providing to said control unit a control signal indicative thereof; and second means for determining the temperature of said heat carrier fluid leaving said first roller, and for providing to said control unit a control signal indicative thereof.

17. A device as recited in claim 16, wherein said heating roller is a tubular roller.

18. A device as recited in claim 16, wherein said heating roller has peripheral bores in the vicinity of its surface.

* * * * *